US010477969B2

(12) United States Patent
Klokk et al.

(10) Patent No.: US 10,477,969 B2
(45) Date of Patent: Nov. 19, 2019

(54) JOINT AND FURNITURE WITH JOINT

(71) Applicant: Ekornes ASA, Ikornnes (NO)

(72) Inventors: Jan Kato Klokk, Sykkylven (NO); Jan Lade, Ikornnes (NO)

(73) Assignee: Ekornes ASA, Ikornnes (NO)

( * ) Notice: Subject to any disclaimer, the term of this patent is extended or adjusted under 35 U.S.C. 154(b) by 0 days.

(21) Appl. No.: 15/518,430

(22) PCT Filed: Oct. 16, 2015

(86) PCT No.: PCT/NO2015/050192

§ 371 (c)(1),
(2) Date: Apr. 11, 2017

(87) PCT Pub. No.: WO2016/060572

PCT Pub. Date: Apr. 21, 2016

(65) Prior Publication Data

US 2018/0116402 A1 May 3, 2018

(30) Foreign Application Priority Data

Oct. 17, 2014 (NO) ..... 20141242
Oct. 17, 2014 (NO) ..... 20141243
Oct. 17, 2014 (NO) ..... 20141244

(51) Int. Cl.
*A47C 7/14* (2006.01)
*A47C 3/025* (2006.01)
(Continued)

(52) U.S. Cl.
CPC ..... *A47C 3/0255* (2013.01); *A47B 83/02* (2013.01); *A47C 7/14* (2013.01); *A47C 7/448* (2013.01);
(Continued)

(58) Field of Classification Search
CPC ..... A47C 3/0255; A47C 7/62; A47C 17/04; A47B 83/02
(Continued)

(56) References Cited

U.S. PATENT DOCUMENTS 2,184,988 A 12/1939 Collier et al.
3,785,600 A 1/1974 Padovano
(Continued)

FOREIGN PATENT DOCUMENTS

DE 8024904 3/1981
EP 0330594 8/1989
(Continued)

OTHER PUBLICATIONS

Patent Cooperation Treaty, "International Search Report," issued in connection with PCT Patent Application No. PCT/NO2105/050192, dated Jun. 9, 2016, 5 pages.
(Continued)

*Primary Examiner* — Mark R Wendell
(74) *Attorney, Agent, or Firm* — Hanley, Flight & Zimmerman, LLC

(57) ABSTRACT

Balance joint (1, 101) suitable for attachment between a seat arrangement (6, 106) and a chair leg arrangement (7, 107). The balance joint comprises first and second mountings (2, 3, 102, 103) together forming a hollow space and at least one hinge pin (4, 104). The mountings (2, 3, 12, 103) are rotatably attached to each other by means of the at least one hinge pin, where at least one elastic packing (5, 105) is arranged in the hollow space and the at least one elastic packing is arranged between the mountings so that the possibilities for expansion of the elastic packing is limited by the mountings (2, 3, 102, 103) in at least two directions. It is also described various furniture using such a balance joint.

14 Claims, 11 Drawing Sheets

(51) Int. Cl.

| | |
|---|---|
| ***A47C 7/44*** | (2006.01) |
| ***A47C 11/00*** | (2006.01) |
| ***A47C 17/02*** | (2006.01) |
| ***A47B 83/02*** | (2006.01) |
| ***A47C 7/62*** | (2006.01) |
| *A47C 17/04* | (2006.01) |

(52) U.S. Cl.
CPC ..... *A47C 7/62* (2013.01); *A47C 11/005* (2013.01); *A47C 17/02* (2013.01); *A47C 17/04* (2013.01)

(58) Field of Classification Search
USPC ..... 297/258.1
See application file for complete search history.

(56) References Cited

U.S. PATENT DOCUMENTS

| | | | | |
|---|---|---|---|---|
| 4,247,072 | A | 1/1981 | McMahan, Sr. | |
| 4,761,036 | A | 8/1988 | Vogel | |
| 4,936,629 | A * | 6/1990 | Young | B60N 2/2821 297/256.12 |
| 6,196,629 | B1 * | 3/2001 | Onishi | B60N 2/2806 297/256.12 |
| 2003/0071502 | A1 | 4/2003 | Marshall et al. | |
| 2004/0080199 | A1 | 4/2004 | Ware et al. | |
| 2009/0127903 | A1 * | 5/2009 | Sjoquist | B60N 2/14 297/256.16 |

FOREIGN PATENT DOCUMENTS

| | | |
|---|---|---|
| GB | 1408430 | 10/1975 |
| JP | 2006068223 | 3/2006 |
| KR | 20130078927 | 7/2013 |
| WO | 8505018 | 11/1985 |
| WO | 8903648 | 5/1989 |
| WO | 9206621 | 4/1992 |
| WO | 0016661 | 3/2000 |
| WO | 2007105031 | 9/2007 |
| WO | 2009113778 | 9/2009 |
| WO | 2011099943 | 8/2011 |

OTHER PUBLICATIONS

Patent Cooperation Treaty, "Written Opinion," issued in connection with PCT Patent Application No. PCT/NO2105/050192, dated Jun. 9, 2016, 9 pages.

Patent Cooperation Treaty, "International Preliminary Report on Patentability," issued in connection with PCT Patent Application No. PCT/NO2105/050192, dated Mar. 6, 2017, 5 pages.

Norwegian Patent Office, "Search Report," issued in connection with Norwegian Patent Application No. 20141242, dated May 15, 2015, 2 pages.

Norwegian Patent Office, "Search Report," issued in connection with Norwegian Patent Application No. 20141243, dated May 15, 2015, 2 pages.

Norwegian Patent Office, "Search Report," issued in connection with Norwegian Patent Application No. 20141244, dated May 15, 2015, 2 pages.

* cited by examiner

JOINT AND FURNITURE WITH JOINT

This patent is a US national stage application of International Patent Application No. PCT/NO2015/050192 which was filed on Oct 16, 2015 under the Patent Cooperation Treaty (PCT), which claims priority to Norwegian Patent Application Nos. 20141242, 20141243 and 20141244 which were filed on Oct. 17, 2014, all are hereby incorporated herein by reference in their entireties.

The present invention relates to balance joint for chairs, sofas and similar sitting devices. With balance joint it is meant a movable joint joining two elements, so that these can be rotated about a balance point or equilibrium point in relation to each other. The invention also relates to recliner with balance joint, and a module based furniture comprising balance joint.

There are a number of solutions for how to make chairs or seats tilt or rock between two or more positions. The seat part can be hinged at the front and abut springs, so that the seat is tilted backwards and down in the chair. Such a solution will make the user sink into the chair and give a comfortable feeling of sinking down into the chair. However, it may give problems when the person concerned wants to get up, as one often have a downwards angle on the thighs from the knees to the hips.

At the same time, there are other simpler solutions more suitable for lighter chairs, for example used in conference halls or on more advanced dining chairs. On such chairs the seat is rotatably mounted to an axe being situated across under the chair, so that the user sitting on the chair, by weight shift, can rock the seat forwards and backwards. To prevent the user from uncontrolled rocking forwards and backwards, can the attachment be connected with a spring arrangement, so that the user pushes the chair out of an equilibrium position where the seat is mainly horizontal. These chairs may also have some sort of blocking, so that the seat only tilts to a defined angle and cannot fall over by accident. Such chairs are relatively comfortably to sit on, by can give unpleasant bumps is one is leaning forwards or backwards so fast that the chair hit against the blocking.

There are also solutions where the chair forms lightweight points at different angles by rotating connections between elements on a central leg on the chair. In addition there are solutions where the seat or the seat and back are bushed by means of rail system and/or hinged arms, between sitting and more reclining positions. Such chairs often may have a comprehensive system with a number or parts functioning in relation to each other and will therefore also be costly for the user. At the same time, it will be a comprehensive process to replace wearing parts in relation to the tilting function, so that the user chooses to throw away the chair instead of repairing is, as repairing may be expensive.

It is an object of the present invention to provide a balance joint providing better comfort than known rotatable joints. It is also an object to provide a joint providing a pleasant tilting movement for the user of a chair or other sitting arrangement provided with joints according to the invention. At the same time it demands few components in the balance joint to obtain a movement in the joint that feels comfortable for the user.

At the same time, the present invention relates to an improved resting chair comprising a balance joint as mentioned above.

The present invention thereby also has as a task to provide a recliner comprising a balance as described above and with an underframe made of fewer parts than available solutions, and providing a larger degree of comfort for the user as the underframe has an adapted elasticity while at the same time having sufficient rigidity to support the sliding mechanism, The present invention also has as an object to provide a free-standing sofa being made of modules where the seat module is provided with a balance joint. Such a sofa is much simpler and quicker to mount that known sofas, while at the same time providing user comfort and comprises fewer parts that furniture made on similar principles.

These and other tasks and objects with a balance joint according to the attached claim 1, a sitting arrangement according to the attached claim 7, a recliner according to the attached claim 8 and a sofa according to the attached claim 9, and also a building kit and a method as these appear in the attached patent claims.

It is thereby described a balance joint suitable for attachment between a seat arrangement and an arrangement for leg of chair characterized in that it comprises first and second mountings together forming a hollow space, and at least one gudgeon, the mountings are rotatably connected to each other by means of the at least one gudgeon, where at least one elastic packing is arranged in the hollow space and the at least one elastic packing is arranged between the mountings so that the expansion possibilities of the elastic packing is limited by the mountings in at least two direction.

As the two mountings are rotatably mounted to each other and an elastic packing is situated between the mountings, the packing will provide gradually increasing resistance as the deflection between the two mountings in the balance joint is increasing. The tilting movement between the mountings will be ceased when the packing cannot longer be compressed between the mountings, as a gradual resistance is obtained until there is a complete blocking of the movement. By this solution it can be prevented that the mountings are bumping onto each other or a blocking device at full rotation of the mountings.

In advantageous embodiments the balance joint comprises mountings formed as an attachment plate and side walls in such a way that the side walls of the first mounting can be arranged on the outside of the side walls of the second mountings. It will then be formed a hollow space delimited by the side walls and the attachment plates, where the elastic packing is arranged in the hollow space. The packing is dimensioned so that it abuts or lies close to at least the attachment plates and side walls. Preferably, the packing is abutting or lie close to the attachment plates and side walls. The packing can also be larger than the hollow space in two or more directions, so that the packing lie preloaded against at least two walls in the hollow space.

In certain embodiments of the balance joint, the side walls are provided with mating holes suitable for lead-through of a gudgeon. The gudgeon will then pass across the balance joint between the attachment plates and form a rotational axis for the parts of the balance joint.

In certain embodiments of the balance joint at least one attachment plate comprises holes for attachment to a seat arrangement or a chair leg arrangement. The balance joint can then easily be screwed or bolted to the chair or furniture on which it is to be used. If the balance joint comprises two attachment plates, both attachment plates can comprise holes, so that the balance joint can be bolted or screwed onto both furniture elements that are going to tilt or rock in relation to each other.

In other embodiments of the balance joint, the attachment plate of a first of the mounting comprises a lead-through hole and where there to the inner surface of the second of the mounting is attached a pedestal protruding through the lead-through hole. This embodiment enables the balance joint to be used in a pedestal connection where one furniture part of the furniture both can tilt about the mountings and rotate about the pedestal connection.

In some embodiments of the balance joint the pedestal comprises a hollow or a threaded hollow in an end part suitable for a fastening element or a threaded fastening element, respectively. The hollow provides an easy way of fastening the balance joint to a fastening element.

It is also described embodiments of a chair comprising a balance joint as described above and a sofa comprising a number of seat arrangements mounted to a chair leg arrangement by means of at least one balance joint as described above. The balance joint provides an improved tilting movement and dampened blocking mechanism in the furniture compared to previously known tilting joints.

It is further described a recliner comprising a seat part being hinged to a back part, were the seat part and the back part are suspended in an underframe, where the underframe comprises a laminated bow carrying two bearers in metal, and a bracket in metal attached centrally to the laminated bow, as the bracket is rotatably attached to a central hub of a foot. In one embodiment of the recliner, the bracket is a tiltable balance joint as described above.

Such a recliner provides both an improved comfort by the special combination of rigid metal elements and laminated elements with a certain elasticity. Such a reclined with a balance joint will obtain an improved comfort in that the chair part can tilt in relation to the foot in addition to the seat and back part being rotatable forwards and backwards about the underframe and hinged in relation to each other in the connection between seat and back part.

In one embodiment of the recliner the laminated bow comprises multiple layers of wood and the arm rest bow comprises an integrated attachment arrangement for attachment of cushion or arm rest bolstering. The laminated bow provides elasticity giving a good comfort for the user while providing sufficient mechanical stability. The laminated bow gives a softer sensation to the user of the chair in that it provides a small yield when the person sitting in the chair is moving. The integrated attachment arrangement in the arm rest comprises a bow section or surface part provided with attaching elements such as holes or knobs, where fitting attaching elements in a cushion or armrest bolstering can be attached.

It is also described a furniture comprising an elongated horizontal aluminium profile and two foot or base elements, where a number of module elements are mounted on the aluminium profile. The aluminium profile comprises at least one groove on the upper side. Each furniture module comprises a seat part, a back part and an attachment bracket on the underside of the seat part, where the bracket comprises at least one bolt arranged to hold into the groove in the aluminium profile. Such furniture will comprise a limited number of single parts, so that it can be transported in modules, it is simple to assemble, gives flexibility in that it is module based and at the same time gives the user a furniture with good sitting comfort.

In one embodiment of the furniture, the bracket comprises a balance joint as described above to provide a rocking connection between seat module and aluminium profile. The balance joint will form a tiltable transition between the seat module and the attachment bracket attaching the seat module to the horizontal profile, which will give an improved comfort for the user. At the same time, the balance joint will absorb and dampen impacts and loads arising when the user moves abruptly in the seat or sit down on the furniture in an abrupt way, e.g. by falling down onto the seat. As the balance joint dampens the movement in the seat module, the load on the attachment between the attaching bracket and the profile is evened out.

In one embodiment of the furniture there is an end piece mounted on the aluminium profile in each end of it. The end piece ensures that the modules are not shifted on the profile and form a decorative ending on the side of the sofa.

In one aspect of the furniture the aluminium profile is hollow and comprises two T-grooves in the side being used as an upper side in the furniture, as each furniture module comprises bolts fitting into the T-grooves. The fitting attachment devices in the profile and modules provide a simple and secure way of attaching the modules to the profile.

In another aspect of the furniture, the aluminium profile comprises two gripping grooves on the side being used as underside in the furniture, arranged to hold the foot or base elements. It is an advantage with extruded aluminium profiles that it is possible to form a complicated cross section on the profiles, where a number of grooves or ribs are formed in the length direction of the profile. The gripping grooves in one of the sides provide a simple and sturdy attachment of foot or base elements.

The furniture elements in the above described furnitures can be taken from the group including a seat, a seat module comprising seat part and back part, a side element or arm rest, a table top and a cabinet. As the grooves in the aluminium profile are adapted to receive elements on several sides of the profile, it is obtained great flexibility in the design of the final furniture based on the above mentioned furniture elements.

It is also described a building kit or prefabricated set for assembly of sofa comprising an elongated aluminium profile provided with longitudinal grooves and a number of module elements comprising two or more foot or base elements, one or more seat modules and two end pieces, where the base elements, seat modules and end pieces comprises anchoring organs fitting with at least one of the longitudinal groove of the aluminium profile.

In one aspect of the building kit or prefabricated set as described above, are one or more side elements or arm rests comprising anchoring organs fitting with at least one of the longitudinal grooves of the aluminium profile.

As the furniture is easy to assemble by means of the elongated profile with various attachment grooves and assigned anchoring organs on the module elements, it would be possible to assemble the final sofa without comprehensive training. The easy assemble would also make the likelihood for erroneous assembly of the furniture very little.

It is also described a method for assembly of sofa comprising the steps of:

- provide an elongated aluminium profile comprising grooves in the surface,
- slide one or more seat modules comprising seat part, back part and anchoring device onto the aluminium profile,
- slide one or more base elements onto the aluminium profile,
- slide an end part onto at least one end of the aluminium profile, and
- attaching modules and elements to the aluminium profile.

In one aspect of this method do the anchoring devices of the seat modules comprise balance joints as described above.

This method for making a module based sofa provides a simple and secure mounting while at the same time obtaining a user-friendly sofa and large flexibility in the design of each sofa model.

For further explaining of the invention examples of advantageous embodiments will now be described in more details with reference to the attached drawings where:

Figure 1:
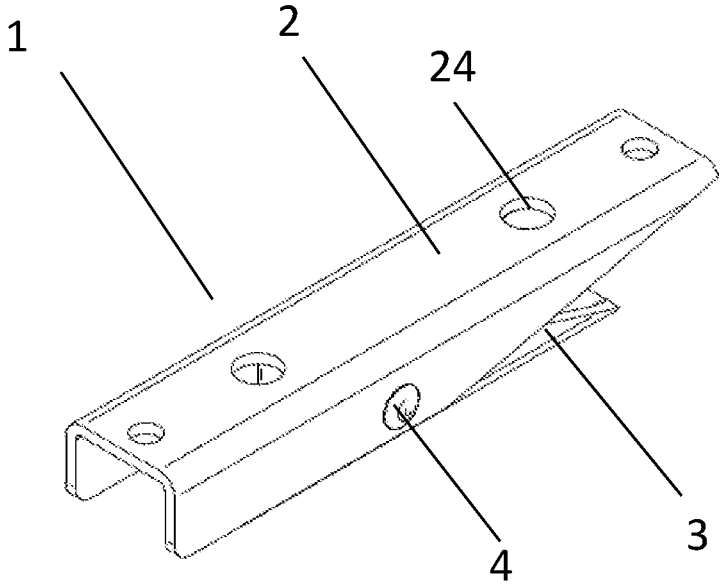
FIG. 1 shows a perspective view of a first embodiment of a balance joint according to the invention, in passive position.
Figure 3A:
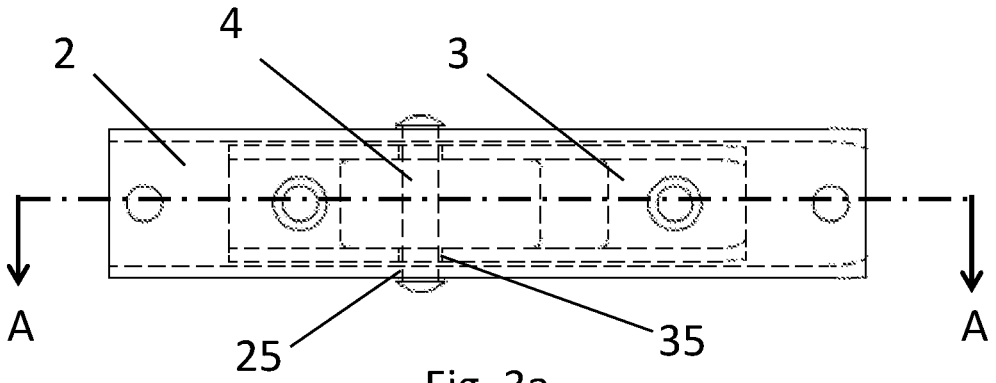

FIG. 3*a* shows a cross section of the tilting joint in FIG. 1, seen from above.

Figure 2:
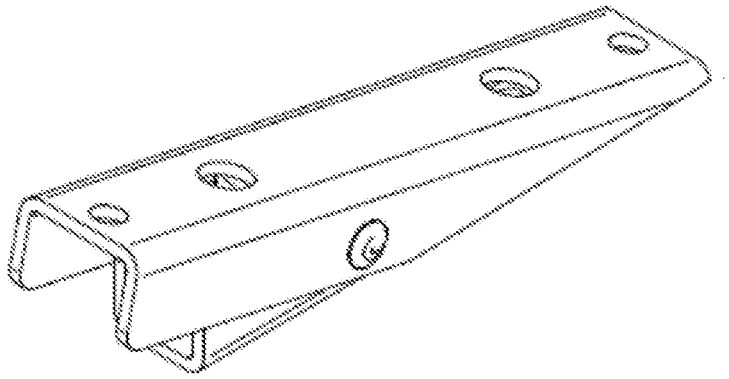
FIG. 2 shows a perspective view of the embodiment of the balance joint in FIG. 1, in a loaded or tilted position.
Figure 3B:
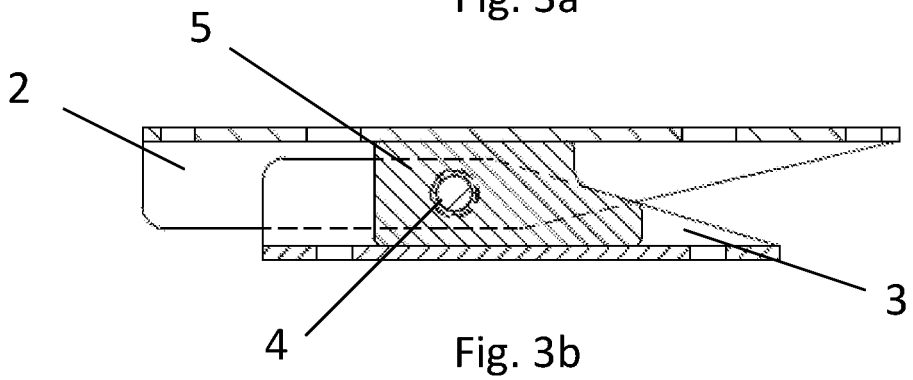

FIG. 3*b* shows a sideways cross section through A-A in FIG. 2*a*.

Figure 4A:
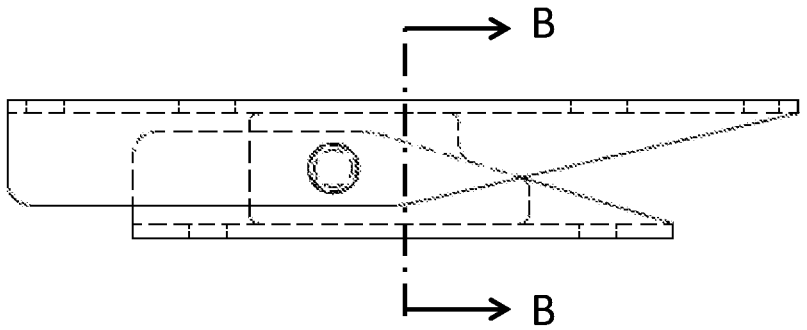

FIG. 4*a* shows a side view of the tilting joint in FIG. 1.

Figure 4B:
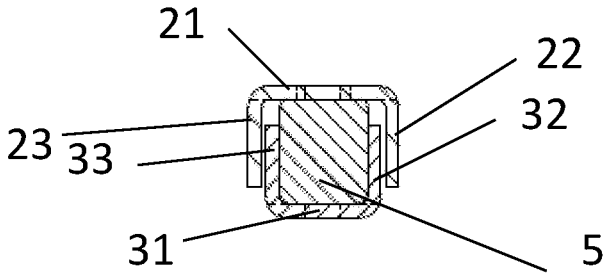

FIG. 4*b* shows a sideways cross section through B-B in FIG. 3*a*.

Figure 5:
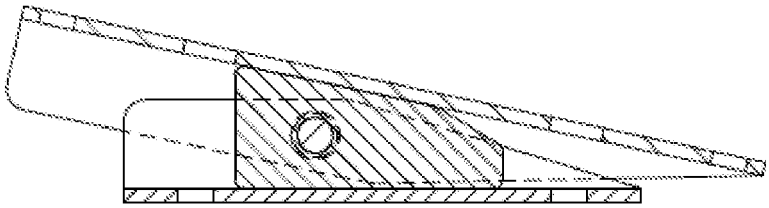

FIG. 5 shows a cross section of the loaded balance joint in FIG. 2, corresponding to A-A in FIG. 2*a*.

Figure 6:
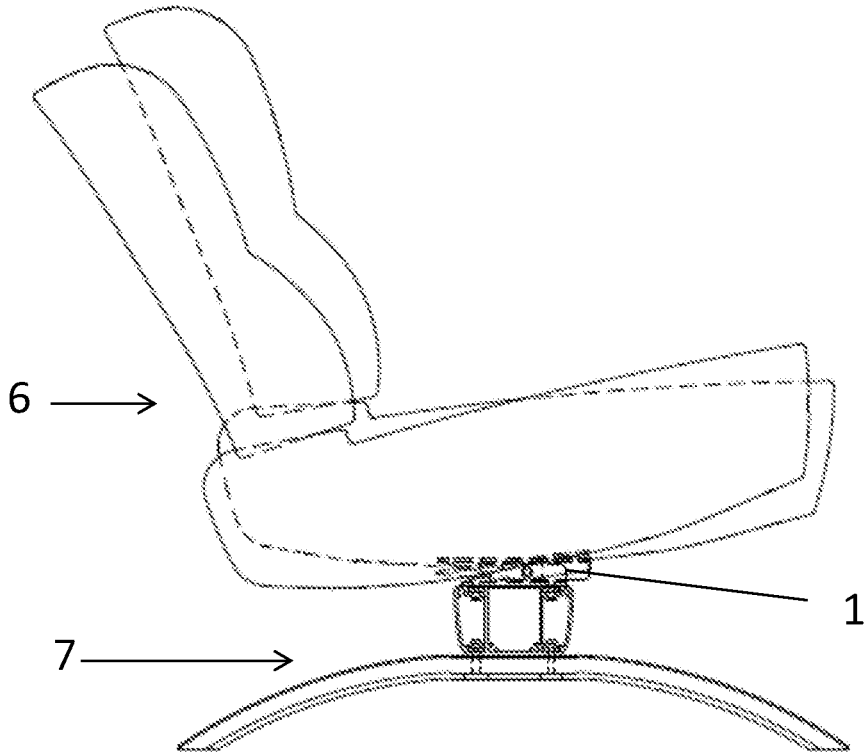

FIG. 6 shows an example of a seat module with the balance joint of FIG. 1, in two different tilting positions.

Figure 7:
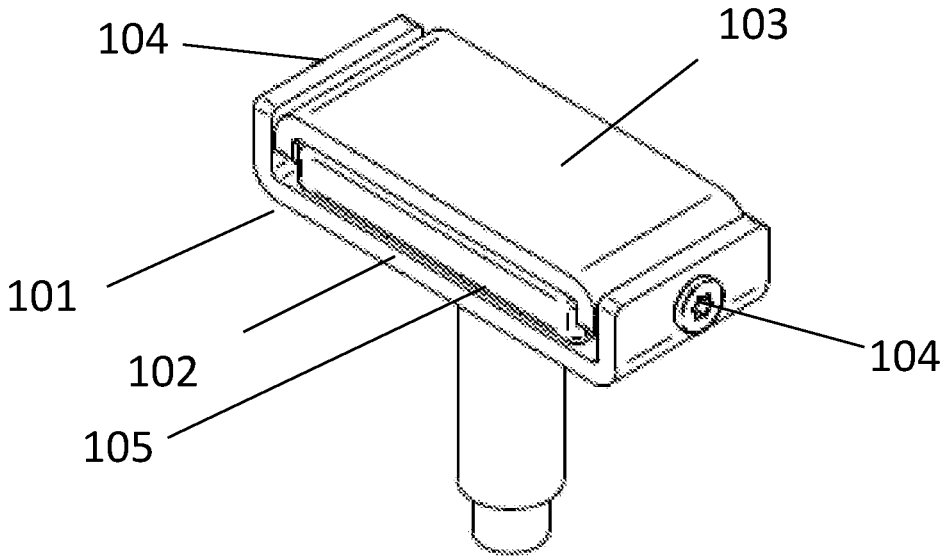

FIG. 7 shows a perspective view of a second embodiment of a balance joint according to the invention, in passive position.

Figure 8:
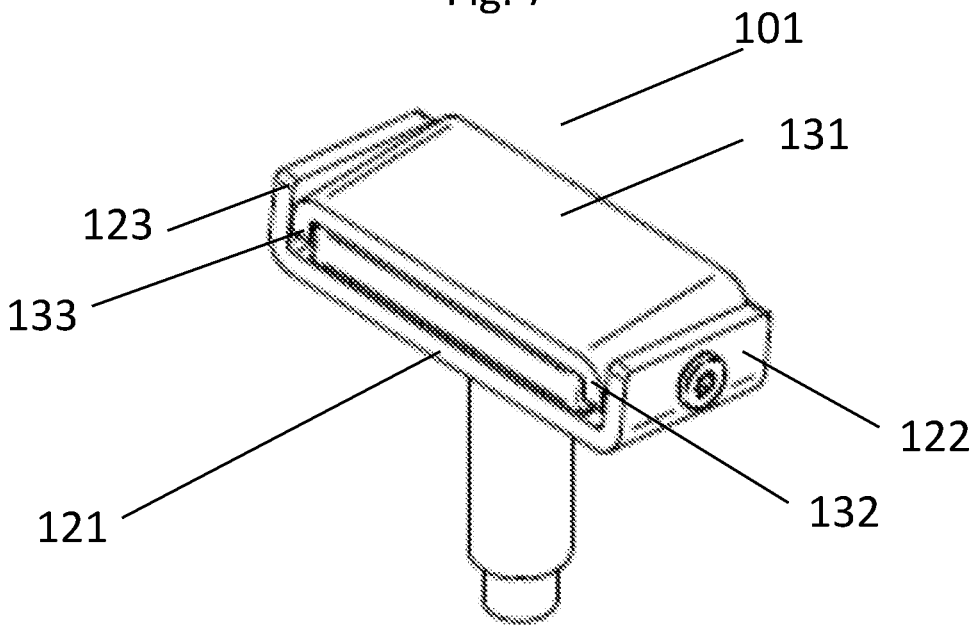

FIG. 8 shows a perspective view of the embodiment of the balance joint in FIG. 7, in loaded or tilted position.

Figure 9A:
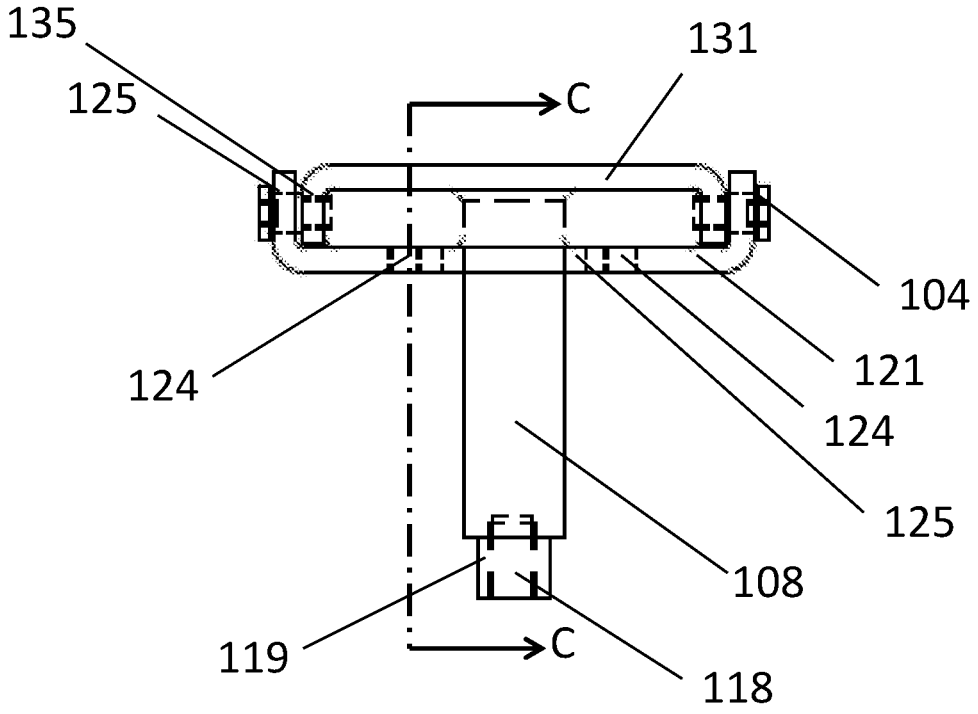

FIG. 9*a* shows a side view of the tilting joint in FIG. 7.

Figure 9B:
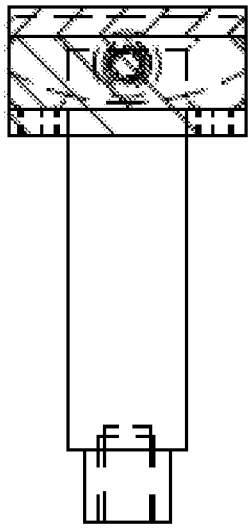

FIG. 9*b* shows a sideways cross section through C-C in FIG. 9*a*.

Figure 9C:
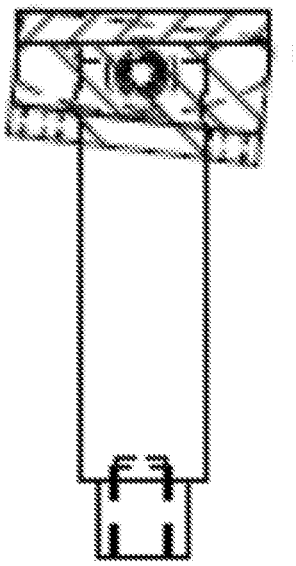

FIG. 9*c* shows a cross section of the loaded balance joint in FIG. 8, corresponding to C-C in FIG. 8*a*.

Figure 10A:
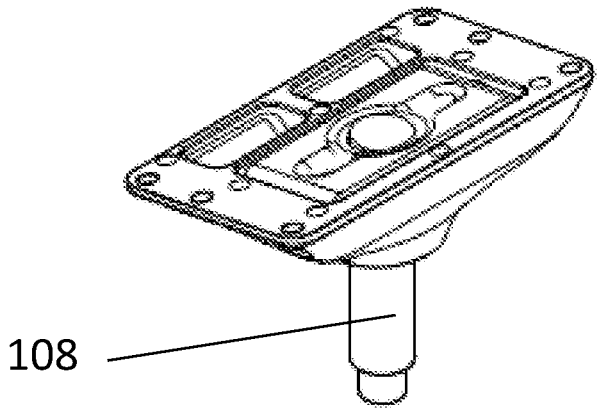
Figure 10B:
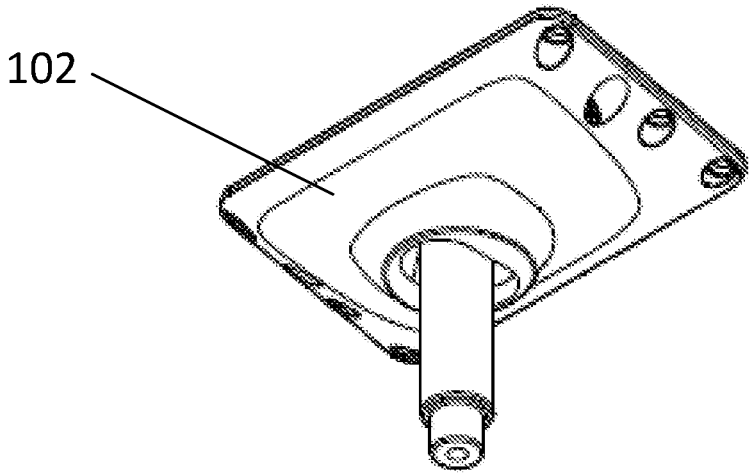

FIGS. 10*a* and 10*b* shows perspective views of a third embodiment of the balance joint.

Figure 11:
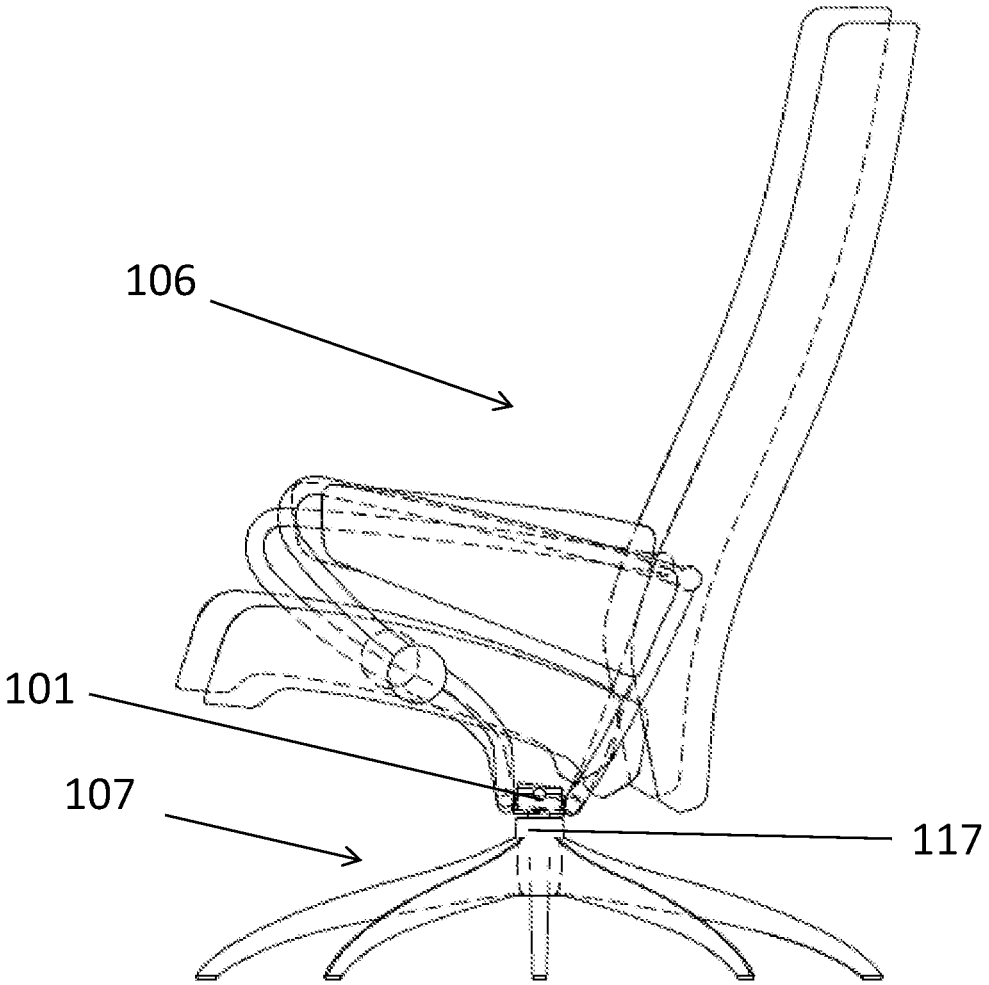

FIG. 11 shows an example of a chair with the balance joint in FIG. 7*m* in two different tilting positions.

Figure 12:
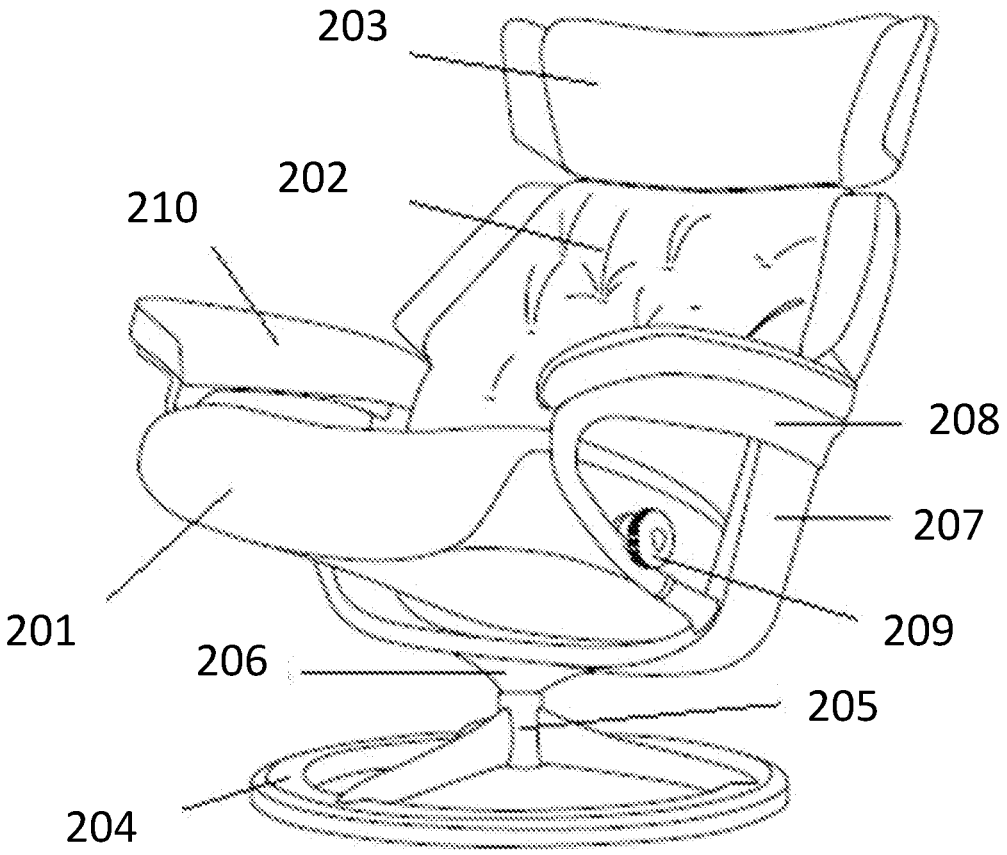
Figure 13:
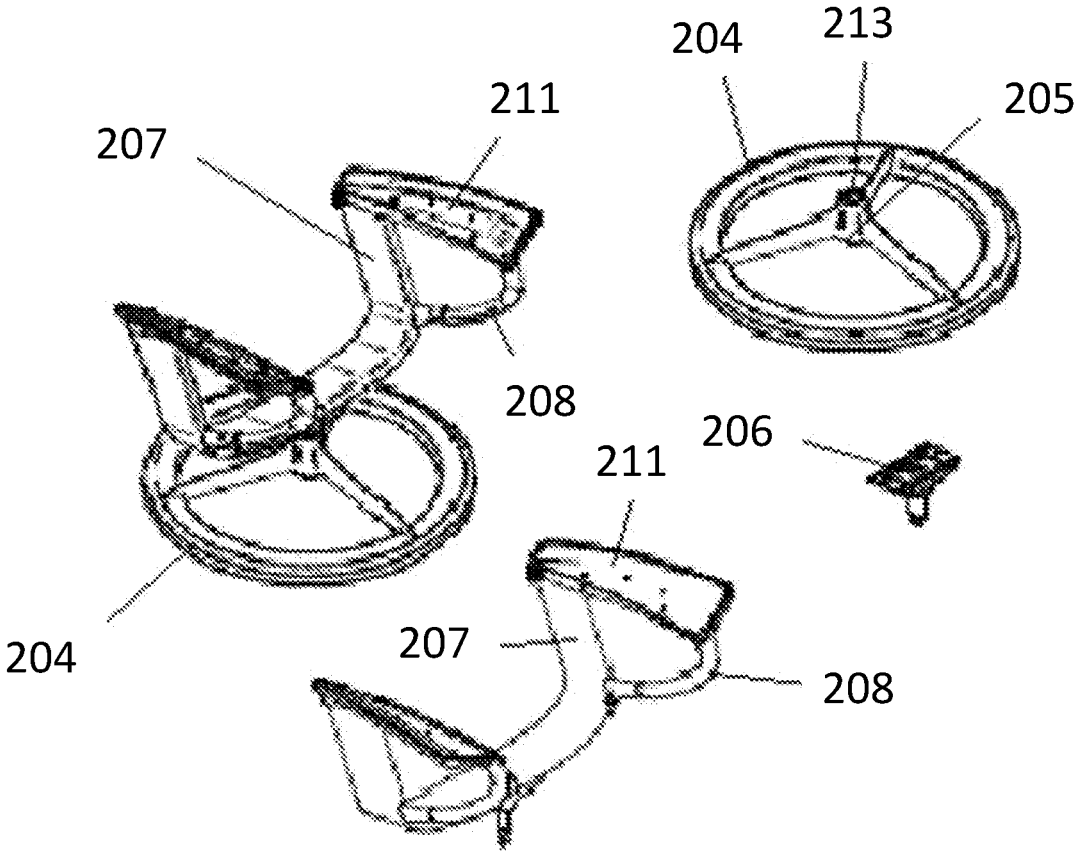

FIG. 12 shows a perspective drawing of a recliner with balance joint according to the invention, and FIG. 13 shows the substructure of the recliner in FIG. 12 in detail.

Figure 14:
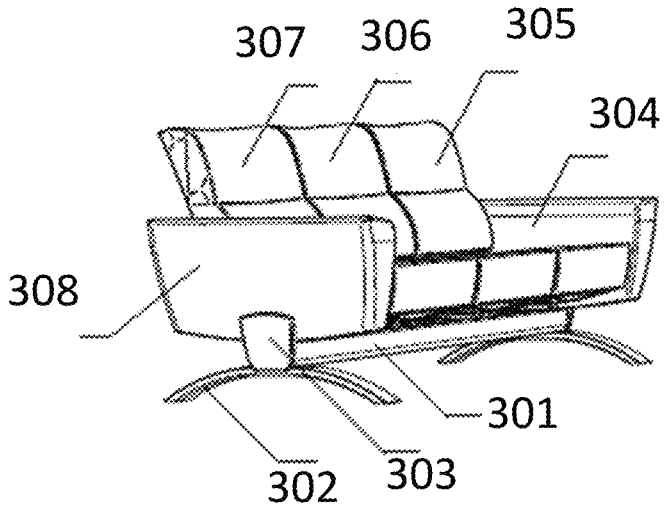
Figure 15:
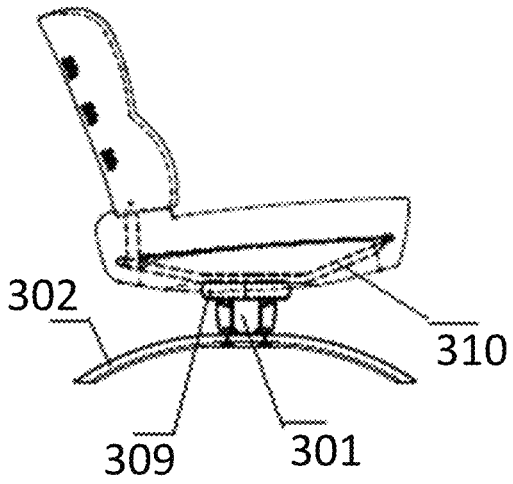
Figure 16:
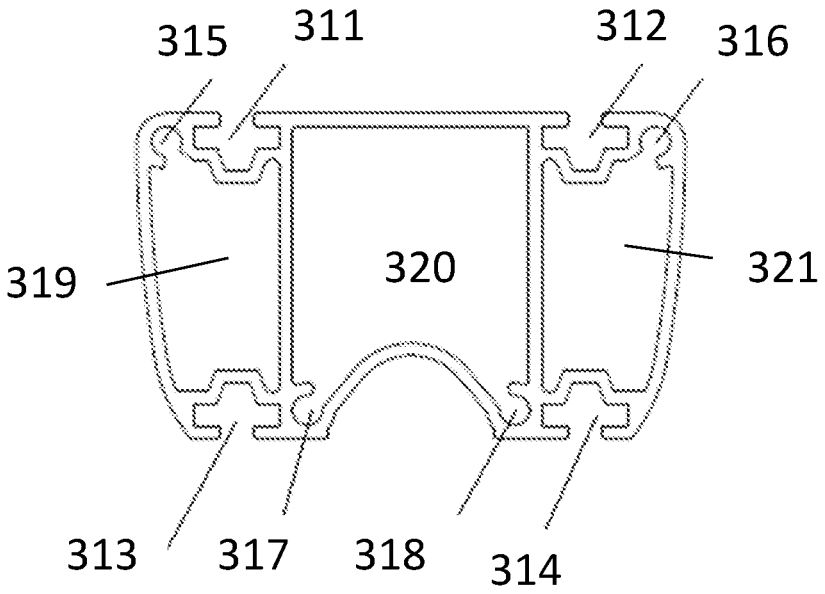
Figure 17:
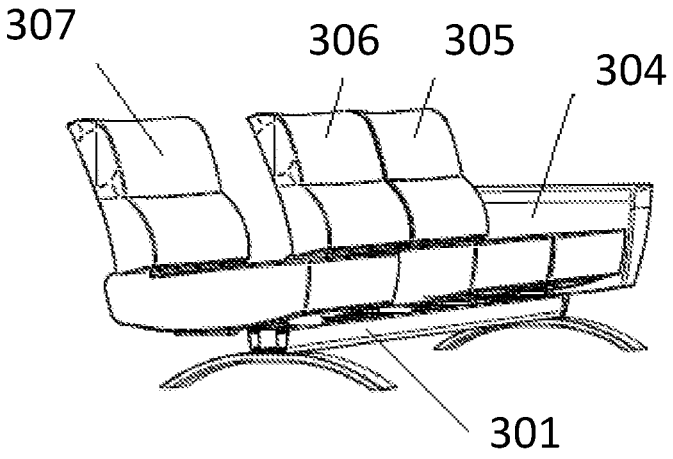

FIG. 14 is an example of a complete assembled sofa comprising a balance joint according to the invention, FIG. 15 is a sideways partial cross section of the sofa in FIG. 14, FIG. 16 shows a section through a profile being included in the sofa of FIG. 14, and FIG. 17 shows the sofa in FIG. 14 during assembly (or disassembly).

FIG. 1 shows a perspective view of a first embodiment of a balance joint 1 according to the invention, in passive position. The balance joint 1 comprises two mountings 2, 3 being rotatably connected to each other by means of at least one gudgeoun or hinge pin 4. By attaching the seat part to the first mounting and the chair leg part to the second mounting 3, the seat will rock in relation to the chair leg by means of the tilting joint. FIG. 2 shows the balance joint in a tilted position.

FIGS. 3*a* to 4*b* shows different views of the embodiment of a tilting joint according to the invention. In addition to the two mountings 2, 3 and the gudgeoun or hinge pin 4, the balance joint comprises at least one elastic packing 5 being arranged between the two mountings adjacent to the hinge pin.

The mountings are formed with a plane attachment plate 21, 31 and two side walls 22, 23, 32, 33, The first mounting 2 has a wider attachment plate 21 than the second mounting 3, so that the side walls 22, 23 of the first mounting 2 can be placed outside the side walls 32, 33 of the second mounting 3. The side walls 22, 32 and 23, 33 are preferably arranged abutting or close to each other, in such a way that there is not created unnecessary friction on the contact surfaces between the two mountings.

The elastic packing is lying close to or abutting the attachment plates 21, 31 of the mountings and the side walls 32, 33 of the narrower second mounting 3 at the gudgeon or hinge pin 4. In the shown embodiment the packing is encircling the hinge pin 4, see especially FIGS. 3*b* and 4*b*. When the mountings 2, 3 are rotated or tilted in relation to each other, the packing will gradually be compressed on one side of the hinge pin. When the packing is compressed, see FIG. 5, the material will seek outwards in the direction of the side walls to compensate for the lack of space between the attachment plates. As the packing is prevented from expanding, it will gradually provide increasing resistance against being compressed, so that the resistance against the rotational or tilting movement will increase with increasing deflection.

When someone is sitting in a chair with a balance joint according to the invention, they will notice that it is gradually more difficult to tilt the joint when the deflection of the seat is increasing, instead of the seat suddenly abutting an edge or fitting surface preventing the chair from tilting too far backwards. To increase the rocking resistance in the balance joint is it possible to preload the elastic packing during assembly of the balance joint, so that it is compressed to a predefined degree of tension in balanced position.

There can advantageously be provided a number of holes 24, 34 in the attachment plates 21, 31 of the mountings 2, 3 for attachment of seat part and chair leg respectively to the balance joint, see FIG. 1.

FIG. 6 shows a seat 6 being attached to an arrangement 7 for a leg of chair by means of a balance joint 1 according to the invention. The figure shows the seat in a passive unloaded position and in a tilted position respectively, where the balance joint is compressed at the rear side towards the back part of the seat 6. The balance joint provides a good and reliable tilting or rocking function to the seat arrangement 6, 7 by means of few parts, while at the same time ensuring a soft stop to the tilting or rocking movement. Furthermore, the balance joint has two attachment plates 2, 3 facing the seat part and the chair leg part of the sitting arrangement respectively; it is not complicated to obtain a good and sturdy connection between the different parts by means of bolts, screws or the like.

As the balance joint is attached by bolts or the like, it is also possible to disassemble toe balance joint for e.g. maintenance or if it is necessary to replace parts of the sitting arrangement. This provides the chair or sofa with balance joint according to the invention with a long lifetime, as it is practical to maintain the chair or sofa instead of replacing it. This can present savings both for the owner of the chair or sofa and for the environment, as the chair or sofa get a longer useful life.

FIGS. 7 and 8 shows a second embodiment of a balance joint 101 according to the invention in unloaded position and rotated loaded position, respectively. The balance joint comprises a first mounting 102 with attachment plate 121 and side walls 122, 123, a second mounting 103 with attachment plate 131 and side walls 132, 133, elastic packing 105 and hinge pins 104. To prevent access to the opening between the two mountings, one of the mountings 102 can be extended and prolonged so that it encompasses the elastic packing 105 and the second 103. Thereby, the packing 105 will not be visible as it will be encapsulated in the enlarged mounting 102. Such an enlarged mounting 102 may also comprise anchoring organs in the form of holes or recesses for attachment to a seat or seat arrangement.

FIG. 9*a* shows a partial cross section of the balance joint, while FIGS. 9*b* and 9*c* shows cross sections along C-C in FIG. 9*a* in unloaded and tilted loaded position, respectively. In this embodiment there is provided a lead-through 125 in the attachment plate 121 in addition to the smaller holes 124 suitable for bolt attachment of the tilting joint to a seat part. Further there is a pedestal 108 lead through the lead-through 125 and attached to the inner surface of the attachment plate 131 of the second mounting 103 in such a way that the pedestal is protruding from the balance joint and thereby forms a, attachment part suitable for anchoring to an arrangement 107 for a leg of chair. Such a pedestal provides a rotatable coupling for the arrangement for leg of chair, so that a chair with a balance joint as described above can rock the seat part and rotate about its own axis.

The balance joint can advantageously be encompassed in a larger fitting so that the opening between the two movable mountings 2, 3 is not accessible or visible when the balance joint is mounted on a chair or a seat in a sofa arrangement. The encapsulation can for example take place by prolongation or expansion with a case arrangement or housing encompassing the second of the mountings in such a way that both mountings still can be attached to each of a seat part or the like and a foot part or the like. Such an encapsulated balance joint is shown in FIGS. 10*a* and 10*b*. In this embodiment the mounting 102 comprises a lead-through enlarged to form the encapsulation of the balance joint. The capsule is provided with holes for attachment on the seat part of a chair, while the pedestal 108 pass through the casing for attachment in a foot part of the chair. The casing can either be unitarily cast with the mounting 102 and attached to the mounting for mounting on the chair.

In the shown embodiment there is provided a threaded hollow 118 axially in the end section 119 of the pedestal suitable for attaching the pedestal to a chair leg arrangement 107 by means of a threaded attachment element, such as a bolt, screw or the like. The pedestal 10 is arranges in the column 117 of the chair leg in the shown example and is attached from below to the chair leg column by means of the attachment element (not shown).

The seat arrangement 106 is attached by means of bolts or the like to the attachment plate 121 of the first mounting. FIGS. 9*b* and 9*c* shows cross sections of the mountings 102, 103, where it is seen how the first mounting 103 is tilting or rocking in relation to the second mounting 102 when loaded. The packing 105 will be pressed together between the attachment plates 121, 131 and thereby try to expand towards the side walls 132, 133 of the second mounting 103. As the side walls are preventing the packing from expansion sideways when compressed, the resistance against the tilting movement will gradually increase. FIGS. 11 and 12 shows examples of chairs provided with balance joint according to the invention.

FIG. 12 shows a version of a recliner according to the invention, comprising a seat part 201 being hinged to a back rest part 202 which again is carrying a head rest 203. The seat and back rest parts are suspended in a underframe or substructure in four suspension organs, whereof a slidably movable wheel device 209 arranged in a bowed arm rest part on each side of the chair between seat part and arm rest area and a rotatably or revolving coupling device in each side of the backrest part of the chair in the contact area between the back rest part and the substructure. The substructure comprises a laminated bow 207 with a mainly plane midsection and two mainly vertical arms. On the bow 207 there is attached two side elements 208. The side elements are formed with a wide upper part and a bowed narrower lower part suitable for slidably mounting of the wheel device 209. The side elements have a double function as each upper part carries an arm rest cushion 210, while the bowed lower parts function as sliding rails for the tilting mechanism of the seat and back rest part.

The bow 207 is in this example laminated of several layers of wood, while the side elements 208 are made of metal. When a user is moving when she is sitting in a chair according to the invention the laminated bow 207 give a certain deflection so that the movements in the chair are softer, whole the side elements 208 in metal are rigid and thereby provide a firm and stable support for the arms. The user would thereby experience both the comfort of the minor deflection in the bow 207 and the safety of the rigidity in the side elements, which will provide and improve sitting experience for the user. The laminated bow 207 is rotatably supported in a foot 204 by means of a bracket or a balance joint 206, that is a joint holding the chair in a balanced resting position, while it also allow a certain deflective movement in the joint so that the seat to some degree can be rocked forwards and backwards. In the shows embodiment, the foot 204 is made of a ring 212 with spokes passing on towards a hub 205, where the ring 212 is made in a laminated material, while the spokes 214 and hub is made in metal. The laminated ring will allow the foot to to some extend follow the movement of the chair, while the spokes and hub in metal ensures a firm connection between chair and foot.

The foot can also be made as a plate. The support or bearing comprises a bracket or a balance joint 206 being attached to the underside of the bow 207, in the middle of the mainly plane part of the bow. The bracket 206 comprises a journal or pedestal 108, see e.g. FIG. 9*a*, that is led down into a bearing in the hub 205. The bracket 206 can also be a balance joint where a first part of the joint is attached to the mainly plane part of the bow and a second part of the joint is provided with a pedestal 208 than can be arranged in the hub 205. The first part of the balance joint is rotatably or tiltably mounted in relation to the second part, so that the bow 207 can be rotatably or tiltably mounted in relation to the second part, so that the bow 207 become rotatably or tiltably coupled to the hub 205, in such a way that the bow and thereby the chair can tilt or rock in relation to the foot. The pedestal is advantageously rotatably arranged in the hub, so that the chair also can rotate about its own axis. The balance joint can advantageously be moulded in a type of casing, so that the movable parts of the joint would not be accessible or visible under the chair. One will then only see the casing mounted to the bow 207 of the chair and the pedestal going down into the hub 205.

The back rest part 202 is suspended in the substructure or underframe in a rotating fulcrum joint on each side of the width of the back rest and mainly in the middle of the height of the back rest part and in the meeting area between the side elements and the laminated bow 207. The seat parts are also suspended in the substructure in sliding units 209 in each side of the seat running along the lower part of the side elements 208. The sliding units 209 are variable in that the friction between the sliding unit and the bow can be varied with a screw or a rotatably friction coupling.

FIG. 13 shows the substructure in greater detail. It is here shown that the laminated bow 207 carries the side elements as these are attached to the laminated bow in two areas. The first area is at the upper end of the bow arm or bow 207 and the lower point is in a little longer down on the arm before the bow is bending down in under chair. The side elements comprise integrated mounting plates 211 for attachment and support of the arm rest cushions. The bracket 206 is shown with a journal or pedestal going down into the bearing 213 in the hub 205 of the foot 204. The bow 207 is laminated in several layers of wood. The bow is constructed in such a way that it provides sufficient deflection to give comfort to the user of the chair while at the same time being sufficiently rigid to support the regulating mechanism for the back. This is obtained by the use of an even and optimal thickness for the bow, by the use of a bow where the thickness is varying from the middle and out towards the arms, or by varying the composition of the layers in the laminated bow. There can also be added layers of metal or fibre-reinforced plastic material in parts of the bow, especially towards the vertical arms.

FIG. 14 shows a sofa comprising three seats. Central for the sofa, there is a hollow aluminium profile 301 standing of two foot bows 302. In the aluminium profile there is mounted in succession a first end arm rest or side element 304, three seat elements 305, 306, 307, and an end side element 308. The furniture elements are attached to grooves in the aluminium profile 301. The profile is closed with end pieces 303 in each end.

FIG. 15 shows the sofa in cross section. The aluminium profile 301 in the shown embodiment is hollow with three chambers. The profile has four T-slots on opposite surfaces of the profile. The foot bow is attached by means of screws in the two lower slots in the profile, with through-going bolts where the heads are entered in the slots. The seat module comprises a bracket 309 being attached to an inner frame 310 in the module. The bracket might comprise a balance joint so that the seat module can tilt or rock in relation to the aluminium profile 301. In the bracket 309 there are likewise arranged two bolts protruding from the underside. Each bolt is interlocking in a slot in the profile 301. The modules can consequently be slided onto the profile 301 until they are in correct position, where after the bolts are tightened and lock the modules to the profile. The end pieces 303 are meant to cover the open ends of the profile, but can also contribute to locking the furniture modules in relation to the profile 301, so that they are prevented from being slid off again after being mounted.

FIG. 16 shows the profile 301 in cross section. The profile is plane on the upper side and underside and comprises three closed chambers 319, 320, 321. In the lower surface, there is arranged to T-slots 313 and 314 each being accommodated to receive one end of a bolt, i.e. either the head of the bolt or a nut sitting on the end of the bolt. In the upper surface there is in the same way arranged two T-slots 311 and 312 arranged to accommodate the bolts sitting in the underside of a furniture module. In the profile there is arranged four longitudinal slots or grooves 315-318 designed for accommodation of screw holding the end pieces in position. Alternatively the end pieces can be designed in such a way that they can be pushed onto the ends of the profile, i.e. they are provided with flanges fitting into the cross section of the profile.

FIG. 17 shows the sofa during assembly. The first side element 304 is put in place and the same applies to first and second seat module 305, 306 comprising seat part, backrest part and attachment bracket, where the attachment brackets on the seat part of the seat modules preferably comprises a balance joint. The last seat module 307 is about to be mounted as it is slid into grooves or slots in the aluminium profile 301, in such a way that the attachment bracket 309 under the seat module is interfering with the slots. After the module is on place, the bolts interfering in the T-slots in the profile are tightened. Thereafter it remains to install the last side element, tighten the bolts and mount the end pieces.

The sofa in the example comprises three seat modules and arm rests. Such a sofa can however comprise both fewer and more seat modules. The seat modules comprises at least one seat part and one backrest part and are self supported. Further is it possible to replace some of the seat modules with for example table plates or low cabinet modules. For that matter is there no hindrance for the substructure with aluminium profile, foot bows and end pieces to be used for other types of furniture than a sofa, for example to carry wardrobe or table. It is also possible to use other types of feet under the profile, or bracket allowing the furniture to be attached to the floor.

The aluminium profile is preferably an extruded aluminium profile. The advantage with such profiles is that the manufacturing process provides high flexibility in choice of cross section on the profile, so that the number of longitudinal slots or grooves can be adapted the seat modules, foot or base modules and/or end brackets to be used. It is for example envisageable that several parallel slots give more attachment fixings or anchorage points and thereby high flexibility in anchoring of a module, while fewer attachment grooves gives a potentially easier assembly and easier anchoring of modules.

It is especially advantageous that such module based furniture presents an easy way of assembling the furniture, while at the same time achieving good sitting comfort for the user. The transverse profile under the sofa will raise the complete sofa construction over the floor and thereby both give a lighter impression than sofas that are going all the way down onto the floor, and increase accessibility to the space under the sofa. The latter will simplify cleaning under the sofa.

As the sofa is easy to assemble it is also possible to transport the sofa parts closest possible the end user before assembly without the risk of erroneous assembly of the modules.

It is especially advantageous to provide the seat modules with an attachment bracket comprising a balance joint, for example as the balance joint shown in FIGS. 1-4. The balance joint will then lie between the seat part of the seat module ad the bracket, so that the bracket is fixed to the below profile on the finished sofa. The seat module will then tilt or rock in relation to the attachment bracket.

Even if the balance joints as shown are open in such a way that the packing arranged in the hollow space between the mountings is accessible from outside, it is also conceivable to provide at least one mounting with two further side walls, so that the packing is locked up in all sideways directions. It is for example envisageable that the first mounting, whose two side walls are lying outside the second mountings side walls, is provided with two additional side walls, so that the hollow space between the mountings is completely delimited by side walls. The side walls can also be enlarged to form some sort of housing around the balance joint.

The first example of embodiment of a balance joint in FIGS. 1-4 shows a packing encompassing a gudgeon or hinge pin, while the second example of embodiment in FIGS. 7-9 shows a packing encompassing a pedestal. The packing is extending to at least two of the walls in the hollow space in the balance joint. In the shown examples, the packing is abutting four of the walls of the hollow space, while it can expand in the last two opposite directions in the hollow space. In an encapsulated embodiment is it envisageably that the packing is filling the hollow space in the balance joint formed by the two movable mountings 2, 102, 3, 103 as the packing has mainly the same volume as the hollow space when the packing is arranged in the hollow space.

However, it is also possible to arrange more than one elastic packing in the balance joint in such a way that the hollow space between the attachment plates and the side walls is mainly filled with packings. For example is it conceivable with an elongated packing on the underside of the hinge pin and an elongated packing on the upper side of the hinge pin abutting each other and each of the attachment plates, short packings lying one each side of the pin or pedestal and thereby fills the hollow space on each side of the pin or pedestal, or a combination of a number of packings abutting each other without further attachment means or being connected to each other with for example glue to optimise the relation between elasticity and rigidity in the packing arrangement.

It is also possible to optimise the rotational resistance in each direction by designing the elastic packing with a narrower or thinner side and a wider or thicker side. In such an embodiment parts of the packing will lie in a distance from at least some of the walls in the hollow space in the balance joint.

Even if it is indicated in the description that the balance joint is attached to the seat arrangement and chair leg arrangement with releasable fixing elements, such as e.g. bolts or screws, it is also possible to attach the balance joint between the seat arrangement and the chair leg arrangement in a permanent way, such as by welding, gluing, soldering or other.

The invention claimed is:

1. A balance joint suitable for attaching between a seat arrangement and a chair leg arrangement, the balance joint comprising:

first and second mountings together forming a hollow space; and at least one hinge pin, wherein the first and second mountings are rotatably mounted to each other by the at least one hinge pin, wherein the mountings include an attachment plate and side walls so that the side walls of the first mounting can be arranged outside the side walls of the second mounting, and wherein one of the mountings includes with two additional side walls, so that the hollow space between the mountings is completely delimited by side walls; and at least one elastic packing arranged in said hollow space and arranged between the mountings so that expansion of the elastic packing is limited by the mounting in all directions.

2. The balance joint according to claim 1, where the side walls of the first mounting and the side walls of the second mounting include mating holes suitable for introduction of at least one hinge pin.

3. The balance joint according to claim 1, where at least one attachment plate comprises holes for attachment in a seat arrangement or a chair leg arrangement.

4. The balance joint according to claim 1, wherein the attachment plate of one of the mountings comprises a lead-through hole and wherein a pedestal protruding from the lead-through hole is attached to an inner surface of another of the mountings.

5. The balance joint according to claim 4, where the pedestal comprises a hollow or a threaded hollow in an end section suitable for an attachment element or a threaded attachment element.

6. A chair comprising a balance joint according to claim 1.

7. A sofa comprising a number of seat arrangements mounted to a chair leg arrangement by means of a balance joint according to claim 1.

8. A furniture comprising an elongated horizontal aluminium profile and two base elements, where a number of furniture modules are mounted on the elongated horizontal aluminium profile, the elongated horizontal aluminium profile comprising at least one groove on an upper side, each furniture module comprising a seat part, a backrest part and an attachment bracket under the seat part, where the bracket comprises at least one bolt arranged to fit into the groove in the elongated horizontal aluminium profile, wherein the bracket comprises a balance joint according to claim 1 for provision of a rocking movement between seat module and elongated horizontal aluminium profile.

9. The furniture according to claim 8, where an end piece is mounted on each end of the elongated horizontal aluminium profile.

10. The furniture according to claim 8, where the elongated horizontal aluminium profile is hollow and comprises two T-slots in an upper side, as each furniture module comprises bolts fitting into the T-slots.

11. The furniture according to claim 8, where the elongated horizontal aluminium profile comprises two slots in an underside, arranged to hold the base elements.

12. The furniture according to claim 8, where furniture elements can be collected from a group including a seat, a seat module comprising seat part and backrest part, a side element or arm rest, a table top and a cabinet.

13. The balance joint according to claim 1, wherein the elastic packing and the hollow space have a same volume.

14. The balance joint according to claim 1, wherein the elastic packing is designed with a narrower or thinner side and a wider or thicker side, such that parts of the packing will lie in a distance from at least some of the walls in the hollow space to optimize the rotational resistance in each direction.

* * * * *